US007617558B2

(12) United States Patent
Boe

(10) Patent No.: US 7,617,558 B2
(45) Date of Patent: Nov. 17, 2009

(54) PIPELINE PIG

(75) Inventor: Ketil Boe, Fana (NO)

(73) Assignee: Prototech AS, Bergen (NO)

( * ) Notice: Subject to any disclaimer, the term of this patent is extended or adjusted under 35 U.S.C. 154(b) by 0 days.

(21) Appl. No.: 10/592,516

(22) PCT Filed: Mar. 9, 2005

(86) PCT No.: PCT/GB2005/000905

§ 371 (c)(1),
(2), (4) Date: Feb. 9, 2007

(87) PCT Pub. No.: WO2005/084833

PCT Pub. Date: Sep. 15, 2005

(65) Prior Publication Data

US 2007/0214590 A1 Sep. 20, 2007

(30) Foreign Application Priority Data

Mar. 9, 2004 (GB) ..... 0405310.4

(51) Int. Cl.
*B08B 9/32* (2006.01)

(52) U.S. Cl. ..... 15/104.061; 254/134.3 FT

(58) Field of Classification Search ..... 15/104.61, 15/104.06, 104.5; 299/31; 254/134.3 FT
See application file for complete search history.

(56) References Cited

U.S. PATENT DOCUMENTS

| | | | | |
|---|---|---|---|---|
| 3,395,759 | A | 8/1968 | Talley, Jr. | 166/155 |
| 4,007,784 | A | 2/1977 | Watson et al. | 166/170 |
| 4,189,186 | A * | 2/1980 | Snyder | 299/31 |
| 4,645,149 | A | 2/1987 | Lowe | 248/1 |
| 6,190,090 | B1 * | 2/2001 | Campbell et al. | 405/211.1 |
| 6,415,722 | B1 | 7/2002 | Reis | 104/138.2 |
| 6,460,616 | B1 | 10/2002 | Simpson | 166/104 |
| 6,722,442 | B2 | 4/2004 | Simpson | 166/381 |
| 6,769,321 | B1 | 8/2004 | Appleton et al. | 73/866.5 |
| 6,775,872 | B1 | 8/2004 | Appleton et al. | 15/104.16 |
| 6,880,195 | B1 * | 4/2005 | Bahari et al. | 15/104.061 |
| 6,944,902 | B1 * | 9/2005 | Richter et al. | 15/104.061 |
| 2007/0214590 | A1 * | 9/2007 | Boe | 15/104.061 |

FOREIGN PATENT DOCUMENTS

| | | | |
|---|---|---|---|
| CH | 669127 | 2/1989 | 9/4 |
| DE | 2756561 | 6/1979 | 3/2 |
| GB | 2167829 | 6/1996 | 55/10 |
| WO | WO 86/01751 | 3/1986 | 9/4 |

* cited by examiner

*Primary Examiner*—Lee D Wilson
(74) *Attorney, Agent, or Firm*—O'Shea Getz P.C.

(57) ABSTRACT

A device can travel along a pipeline which has fluid flowing along the pipeline. The device is able to extract power from the fluid flow in the pipeline and to use that power to move the device along the pipeline against the fluid flow. The device is arranged in a series of coupled modules.

23 Claims, 14 Drawing Sheets

PIPELINE PIG

This application is entitled to the benefit of, and incorporates by reference essential subject matter disclosed in, PCT Application No. PCT/GB2005/000905 filed on Mar. 9, 2005 and Great Britain Application No. 0405310.4 filed on Mar. 9, 2004.

BACKGROUND OF THE INVENTION

1. Technical Field

This invention relates to pigs for travelling through pipelines through which fluid flows or is intended to flow in order to carry out inspection, cleaning and other maintenance.

2. Background Information

Pipeline pigs in general are well known in the art, and many different configurations thereof are in use and an even higher number of configurations has been proposed. A general characteristic of known pigs is the requirement for an umbilical cord. Such a cord is typically used on one hand to supply power to the pig and to control its movement and may also be used on the other hand to return data to the operator e.g. a visual picture of the inside of the pipe.

For ongoing maintenance once a pipeline has been commissioned, it is usually impractical to halt the flow of fluid through the pipe and so it is normally necessary for the pig to operate while the fluid is flowing. Whilst advantage may be taken of this in one direction of the pig's travel, e.g. to deploy the pig, by allowing it to be carried along by the fluid flow; when it is required that the pig travels in the other direction, it is necessary to drive the pig against the flow. This is normally achieved by providing the pig with a motor which is powerful enough to drive it against the forward pressure of the flowing fluid.

The option of providing batteries on the pig to power such a motor would almost always be impractical due to their weight and the amount of power which would be needed.

It is an aim of the present invention to provide an improved pig and when viewed from a first aspect, the invention provides a device for travelling along a pipeline having fluid flowing along it, said device comprising means for extracting power from said fluid flow and using said power to move the device along the pipeline against the fluid flow.

DISCLOSURE OF THE INVENTION

Thus it will be seen that in accordance with the present invention a pig or like device is provided which utilises the power available in the flowing fluid to move the device along the pipeline against the fluid flow. This allows the device to be used in pipelines in which fluid is still flowing, whilst reducing or eliminating the need to provide an external power source to drive it.

Such a device would be advantageous even if it were nonetheless provided with an umbilical cord since it will reduce the requirement for power to be supplied along the cord. Preferably however the device is adapted to extract all of the power needed to move the device against the fluid flow without requiring power to be supplied externally.

An umbilical cord could still be used to communicate with the device since a lighter cord may be provided than if it also supplies power. Most preferably however the device does not have an umbilical cord and may thus be completely independent. It will be appreciated that this can drastically simplify its use and furthermore removes any restriction on its range of travel which would otherwise have been imposed by a tether such as an umbilical cord. Where the device is required to transmit information in real time it preferably comprises means for wirelessly transmitting said data—e.g. radio transmitting means.

Many different mechanisms for moving the device against the fluid flow in the pipeline may be envisaged. For example, a propeller or jet propulsion could be employed. Preferably, however, the device is arranged to crawl along the edge of the pipeline. Such an arrangement is novel and inventive in its own right and thus when viewed from a second aspect the invention provides a device for travelling along a pipeline, said device comprising means for crawling along the inside surface of the pipeline.

Preferably such a device is arranged to crawl against the flow of fluid in the pipeline, most preferably using power extracted from said fluid flow as in accordance with the first aspect of the invention.

In the most preferred embodiments, the device comprises two sets of legs moveable relative to one another, the legs being selectively engageable with the inner surface of a pipeline.

The legs may be of any suitable shape but in preferred embodiments comprise a foot portion adapted to contact the pipe wall wherein the foot portion is shaped to include part of a logarithmic spiral centered on the pivotal axis of the leg. This feature is beneficial as it allows a substantially constant angle to be maintained between the pipe axis and a line through the point of contact of the foot portion and pipeline and the pivot axis of the leg, even if the interior profile of the pipe changes or is uneven causing the point of contact to move along the foot portion. This helps to prevent the leg slipping and is similar to the principle used in some rock-climbing aids to arrest sudden falls. Further details of the application of logarithmic spirals to gripping devices in the field of climbing aids may be found, for example, in U.S. Pat. No. 4,645,149.

The contact angle referred to above is chosen to suit the friction conditions prevailing in the pipeline. For example where friction is high such as in a dry concrete pipe, a contact angle of only 70 degrees may be sufficient. On the other hand in a stainless steel pipe carrying oil the available friction will be much lower such that a contact angle of as much as 86 may be necessary to avoid slipping. The contact angle is therefore preferably between 70 and 86 degrees. For example the contact angle may be between 70 and 85 degrees. In one specific example the contact angle is approximately 78.5 degrees.

Preferably the legs are operated by a crank mechanism driven by the fluid flow. Most preferably such a mechanism comprises a crank wheel whose axis is perpendicular to the main axis of the device. In some embodiments envisaged the eccentricity of the crank is adjustable. This allows its mechanical advantage to be adjusted to apply greater or lesser force to the legs (with an inverse effect on the average speed of movement of the legs). Such adjustment could be manual, e.g. with a simple bolt held in the required position along a slot. Alternatively a powered mechanism could be provided which would allow remote operation—e.g. in real-time while the pig was operating in a pipeline.

Preferably the device comprises means for deploying the legs when required, e.g. upon receipt of a suitable signal. Such a signal could, for example, be generated remotely or could be generated on board the device on the basis of the distance traveled, time elapsed, landmark reached etc. In some preferred embodiments the legs are resiliently biased to their deployed position, the deployment means comprising releasable latch means for holding the legs in their retracted positions such that the legs may be deployed by releasing the latch.

In an alternative set of embodiments one or more actuators is provided to deploy and/or retract the legs. This would allow repeated journeys through the pipe without having to remove the pig to re-latch the legs manually.

The legs are preferably coupled together such that they may be deployed as one. For example, such a coupling may take the form of a mechanism similar to that found in umbrellas. This is beneficial as it requires only a single latch and/or actuator.

The means onboard the device for moving the device against the fluid flow could be arranged to operate on electrical power derived from the flowing fluid. This could be advantageous where another power supply is also available, e.g. for back-up purposes, or where electrical power is required to operate other equipment on the device. In presently preferred embodiments however, the moving means is driven mechanically by the fluid flow. Such an arrangement is considered to be more reliable and less costly to implement and is also generally more efficient since it obviates the need for double conversion of power.

The device may be used just for passive inspection of the inside of the pipeline which could be a visual inspection or any other form of measuring such as ultrasonic, microwave, magnetic etc. Preferably, however, the device comprises one or more tools. The tools provided will depend upon the particular application. In some preferred embodiments, means are provided on the device for removing deposits on the inside of the pipeline wall. For example, brushes, scrapers or other suitable implements could be provided. Some forms of tools could be arranged to operate entirely passively as the device passes along the pipeline. Often, however, it will be necessary to provide active tools in order for them to operate effectively. Although a separate source of power such as a battery would be a more feasible option for operating such tools than for driving the device, preferably the device comprises actively operated tools which are also driven by power extracted from the fluid flow. Indeed, this concept is novel and inventive in its own right and thus when viewed from a third aspect the invention provides a device for use in a pipeline having fluid flowing along it, said device comprising means for extracting power from said fluid flow and using said power to drive one or more tools provided on the device.

Preferably a common means for extracting power from the fluid flow is used to drive the tool or tools as well as moving the device against the flow.

In accordance with the invention, the device can be entirely self sufficient. For example, in some preferred embodiments it is arranged to travel a predetermined distance along the pipeline before returning. Alternatively the device could be sensitive to some form of external marker provided inside or outside the pipeline.

In other embodiments, however, the device is provided with means for receiving remotely transmitted control signals. Such means may, for example, comprise a radio frequency receiver. This might allow greater control and flexibility of use for the device.

A radio receiver or the like may quite feasibly be provided with its own power supply in the form of a battery or the like. In some embodiments however, the device comprises a generator for generating electrical power from the fluid flow for powering electronic equipment, e.g. the aforementioned radio receiver, onboard the device. Other electronic equipment may be provided such as a radio transmitter for transmitting data from the device, means for recording data for later analysis, means for processing data collected and means for controlling and interfacing with sensors, tools etc. on the device.

The device could take the form of an integrated unit but preferably it comprises a plurality of modules. This is beneficial as it allows particular configurations of devices to be constructed to suit particular applications. Preferably, all of the aforementioned features of the device are provided in separate independent modules so as to allow them to be selectively used for a particular application as required.

Preferably, at least some of the modules are coupled to one another in such a way as to transmit mechanical drive between them. Thus by providing a module for extracting power from the fluid flow and converting it to mechanical drive—e.g. a turbine—such extracted power may be used by other modules, regardless of their order in the preferred embodiment.

This is also novel and inventive in its own right and thus when viewed from a fourth aspect the invention provides a device for travelling along a pipeline, said device comprising a plurality of modules coupled to one another in such a way as to allow mechanical drive to be transmitted between them.

The modules may maintain a fixed axial separation from one another. However in some preferred embodiments the modules are arranged to move axially with respect to one another. In a particularly preferred example of this the relative axial movement is used to implement the two sets of legs movable relative to one another that allow the device to crawl along the pipe in accordance with preferred embodiments of the invention. This would have for example a first module or group of modules including a first set of legs and a second module or group of modules including a second set of legs wherein the first and second modules or groups are moveable relative to each other.

Preferably the device comprises means for selectively increasing and decreasing its resistance to fluid flowing past it. Such means may thus be used to reduce the resistance whilst the device is being driven against the fluid flow, but may increase the resistance to maximise thrust on the device when it is carried along with the flow.

Devices described herein may be used in pipes carrying any fluid—liquid or gas—e.g. oil, water, mud, slurry, natural gas.

BRIEF DESCRIPTION OF THE DRAWINGS

Certain preferred embodiments of the invention will now be described, by way of example only, with reference to the accompanying drawings in which.

DETAILED DESCRIPTION OF THE INVENTION

Figure 1:
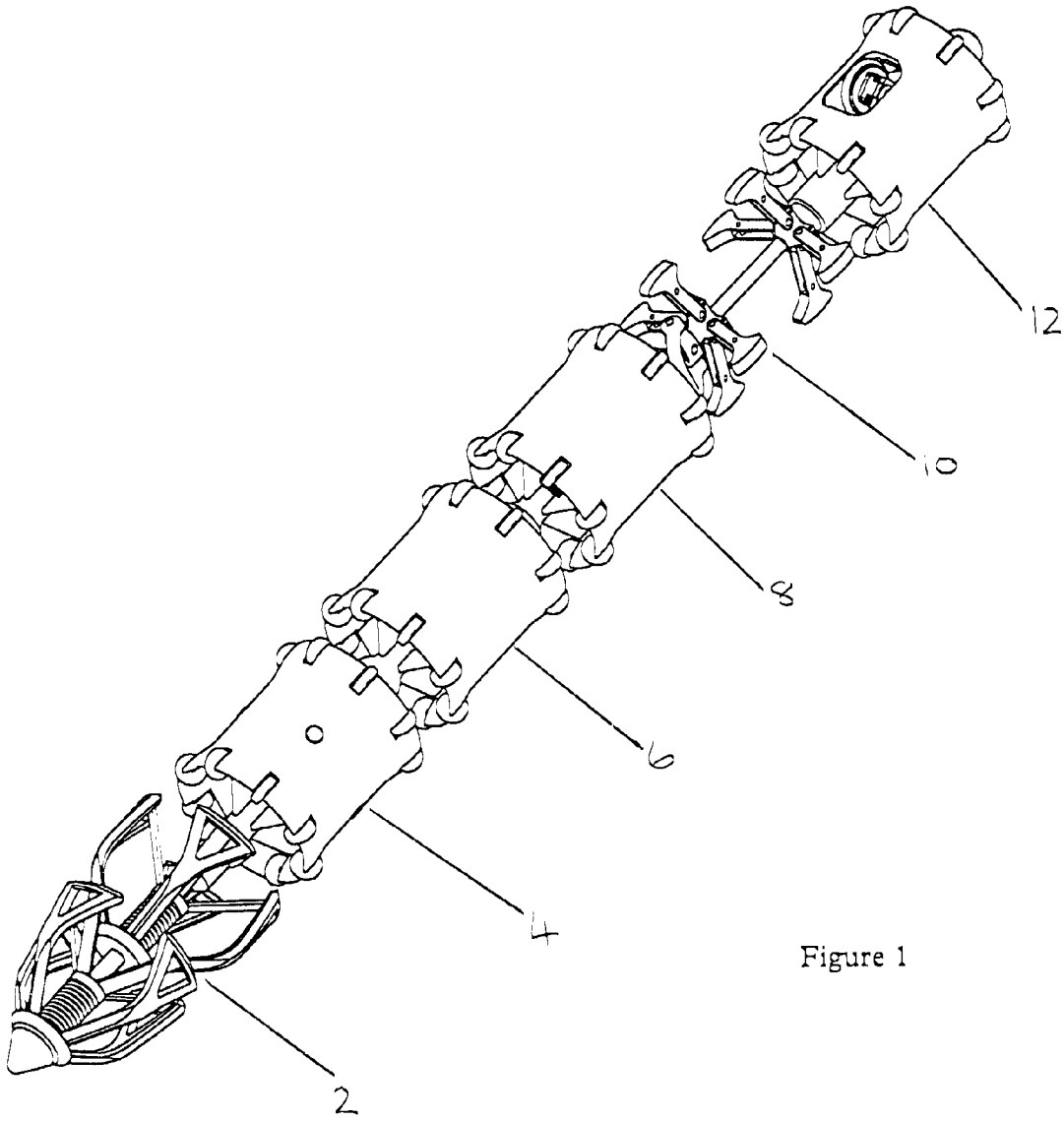
FIG. 1 is a perspective view of a pig in accordance with the present invention.

Turning firstly to FIG. 1, there may be seen a perspective view of a pig in accordance with the invention which may travel along a pipeline such as an industrial water pipeline to remove deposits from the inside wall thereof, although similar devices could also be used in other pipelines such as those for oil or gas for example.

Starting at the front of the pig, there may be seen a tool module 2; a resistance module 4; a turbine module 6; a gear module 8; a crawling module 10; and a control module 12 at the rear. Each of these modules will be described in greater detail with reference to FIGS. 2 to 12.

Figure 2:
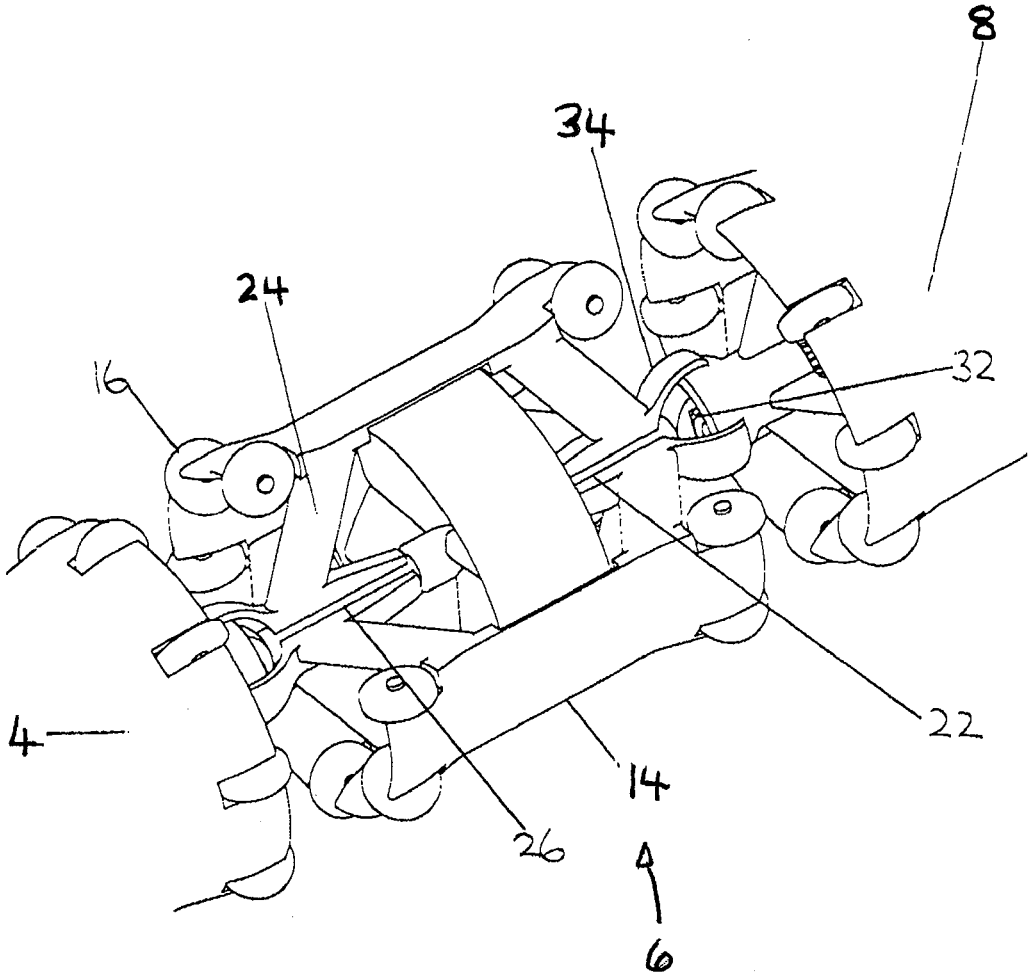
FIG. 2 is a close up view of the turbine module of FIG. 1.
Figure 3:
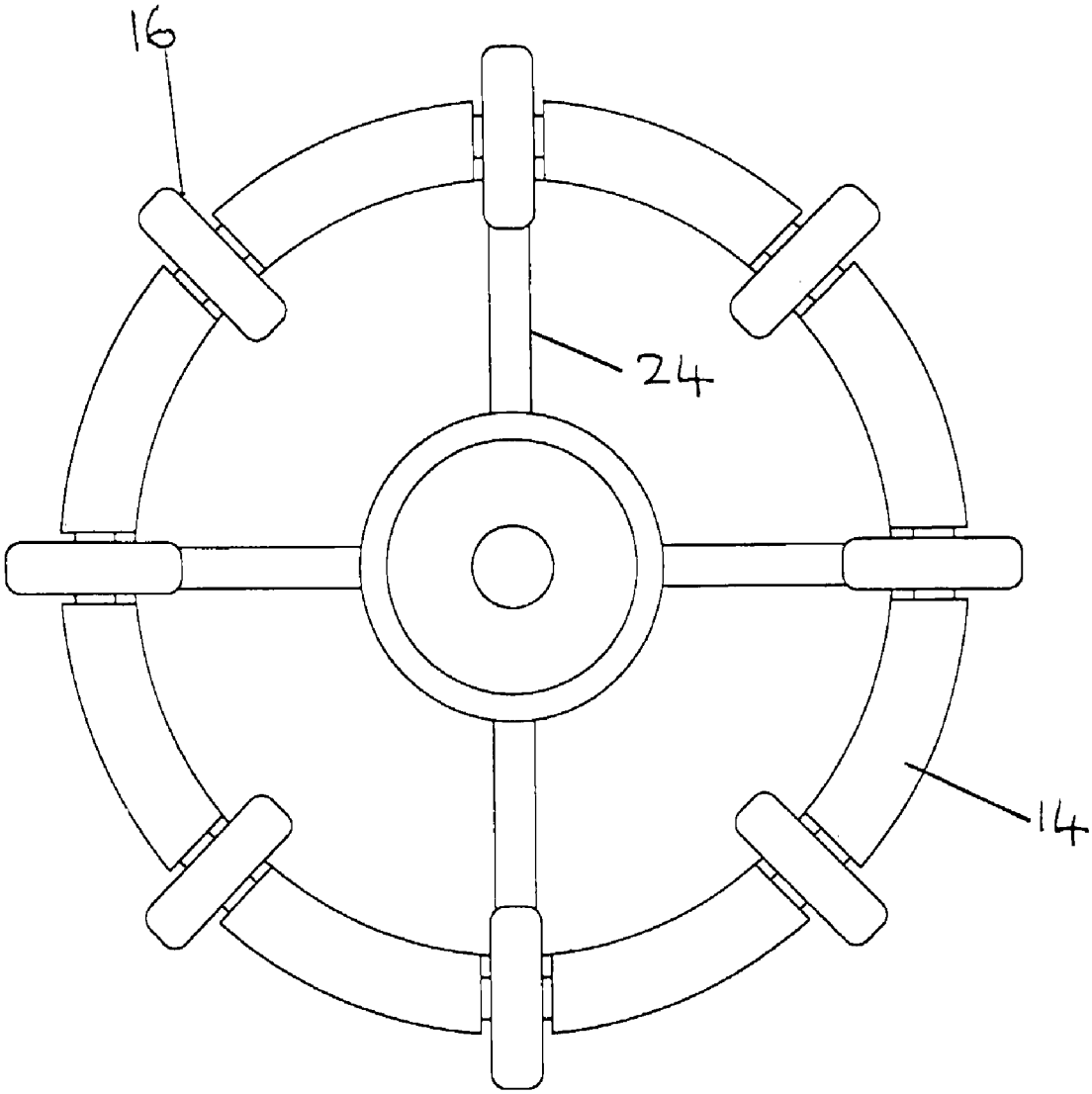
FIG. 3 is an end view of the body of the turbine module.
Figure 4:
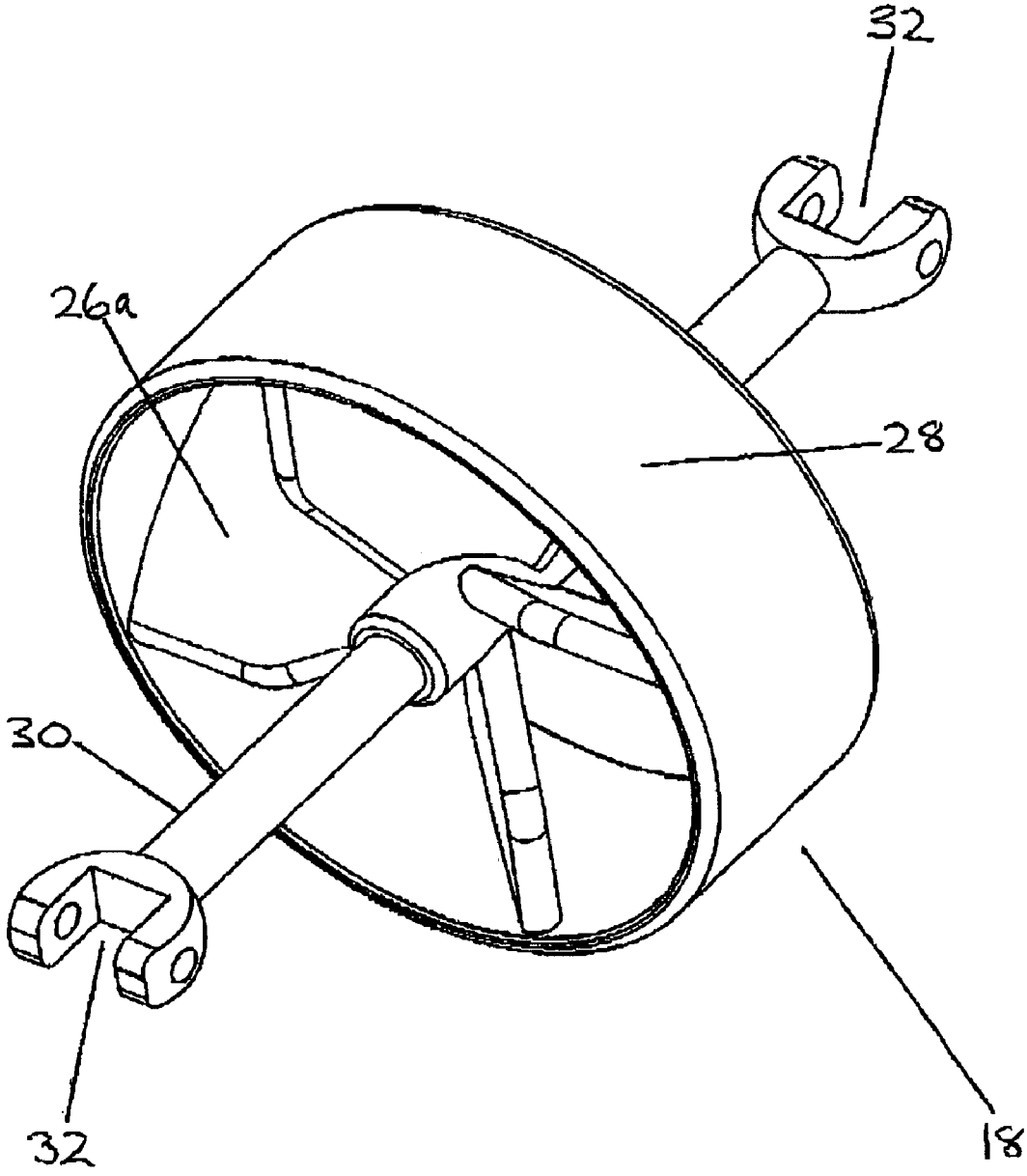
FIG. 4 is a perspective view of the turbine component.

Turning firstly to FIGS. 2, 3 and 4, the turbine module 6 will be described. The turbine module 6 comprises a generally cylindrical hollow body 14. Two series of circumferentially spaced wheels 16 are mounted at the two ends of the cylinder to project normally from the body 14. The wheels 16 thus engage with the inside wall of a pipeline (not shown) in use. The wheels are mounted so as to be freely rotatable, thus allowing the module 2 as a whole to slide freely along the pipeline. It will be appreciated that FIG. 2 shows part of the module to cut away to allow the interior thereof to be seen.

A turbine element 18 is rotatably mounted along the axis of the module 2 by axle mounts 20,22 at either end which are attached to the module body 14 by being formed integrally with angled spokes 24. As may be seen most clearly in FIG. 4 the turbine module 18 comprises a set of circumferentially spaced blades 26*a* surrounded by an annular shroud 28. The blades 26*a* are fixed to an axle 30 which has universal couplings 32 at either end.

It will also be seen that extending axially outwardly of the axle mount portions 26 at either end are ball sockets 34 to allow a ball and joint coupling to the two adjacent modules 4, 8 to be made in such a way that encloses the universal joints 32 between their respective axles. As indicated in FIG. 2, the turbine element 18 is arranged to rotate anti-clockwise when viewed from the direction of flow.

Figure 5:
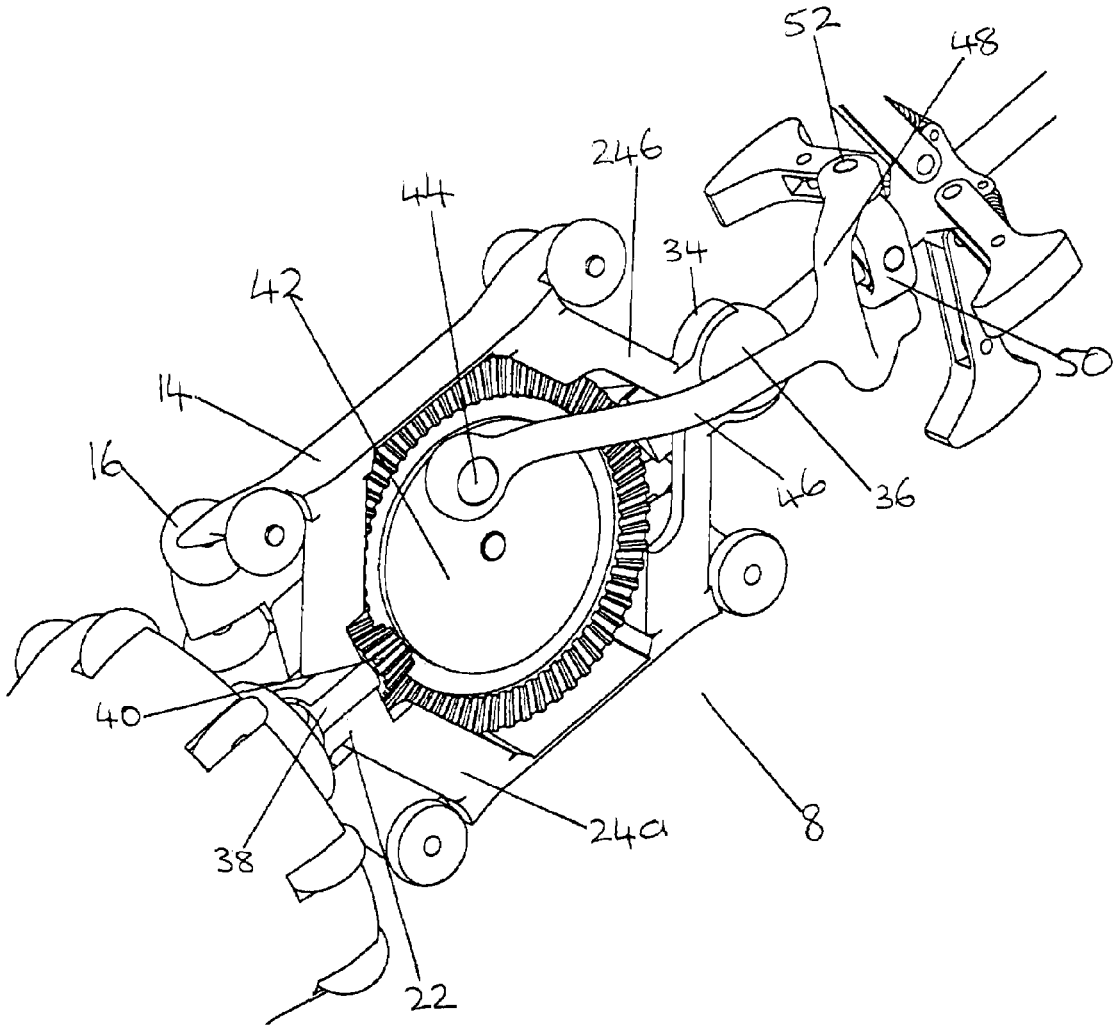
FIG. 5 is a close up view of the gear module of FIG. 1.

FIG. 5 shows the gear module 8. This module also comprises a generally cylindrical housing 14 with wheels 16 mounted normally thereto at opposed ends. Equally, at the foremost end of the module angled spokes 24*a* support an axle mount 22. One difference to be noted over the previous module however, is that the axle mount 22 is formed with a spherical forward-projection (not visible in FIG. 5) which is received in the socket 34 of the turbine module 6. At the rearmost end of the module, the spokes 24*b* do not support an axle mount but are attached to a rearwardly projecting socket 34 for receiving a spherical protrusion 36 of the next module (the crawling module 10).

The axle mount 22 at the front of the module receives a stub axle 38 which is provided with a bevelled pinion gear 40 at its rear end. Although not visible in FIG. 5, the front end of the stub axle 38 is provided with a universal coupling which is attached to the universal coupling 32 of the turbine element 18 shown in FIG. 4.

A bevel crank gear 42 is mounted at right angles to the axis of the bevelled pinion 40 and of the module as a whole so as to mesh with the pinion 40.

The bevel gear 42 has an eccentrically located boss 44 protruding normally from its front face which receives the eye of a crank member 46. At the other end of the kinked shaft of the crank member 46 is a yoke 48 which is pivotally coupled to a sliding coupling 50 on the next module 10. The sliding coupling 50 is described in greater detail with reference to FIG. 6.

The gear module therefore transmits the rotary motion of the stub axle 38 about the axis of the modulate to a geared down rotary motion transverse to the main axis which is in turn converted into a reciprocating linear movement of the sliding coupling 50 of the next module 10 by the crank member 46.

In the embodiment shown in the drawings the boss 44 mounting the crank member 46 is fixed to the face of the gear 42. However further embodiments are envisaged in which the connection point between the crank and the gear is adjustable. This would allow a choice to be made between a smaller but more powerful cranking movement or a larger but less powerful cranking movement for a given gear torque. Such adjustment could be manual, e.g. with a simple bolt held in the required position along a slot. Alternatively a powered mechanism could be provided which would allow remote operation—e.g. in real-time while the pig was operating in a pipeline. This would be useful in allowing a greater crawling force to be applied in the event the pig became stuck.

Figure 6:
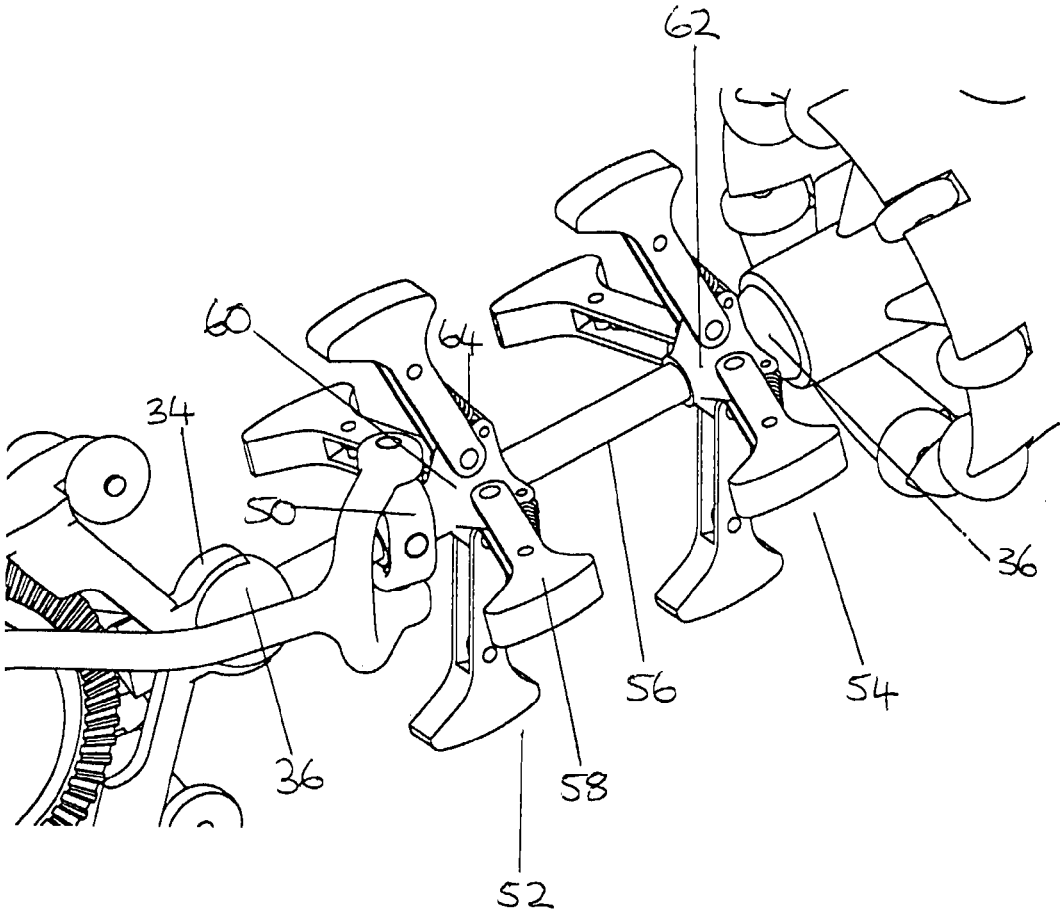
FIG. 6 is a close up view of the crawling module of FIG. 1.

The crawling module 10 is shown in FIG. 6. This module does not have a body or wheels but rather comprises two sets of legs 52, 54 about a common shaft 56. The left part of this Figure will be seen to correspond to the right part of the previous Figure. Thus the spherical protrusion 36 attached to the shaft 56 and received in the socket 34 of the gear module 8 may be seen. A similar spherical projection 36 is provided at the other end of the shaft 56.

The first set of legs 52 comprises four equally spaced leg members 58 which are hingedly mounted to a central boss 60. The central boss 60 is formed integrally with the previously mentioned sliding coupling 50 so that the two may slide together along the shaft 56.

The second set of legs 54 also comprises four equally spaced leg members 58 hingedly mounted to a central boss 62. However, the boss 62 of the second set of legs 54 is rigidly attached to the shaft 56 rather than being able to slide along it. All eight of the individual leg members 58 are resiliently biased to the radially outwardly projecting positions shown in FIG. 6 by respective coil springs 64. This allows the leg members 58 to accommodate unevenness in the internal profile of the pipeline caused, for example, by rough tolerances, dirt, faults, poor welding and of course planned bends in the pipe.

Figure 11:
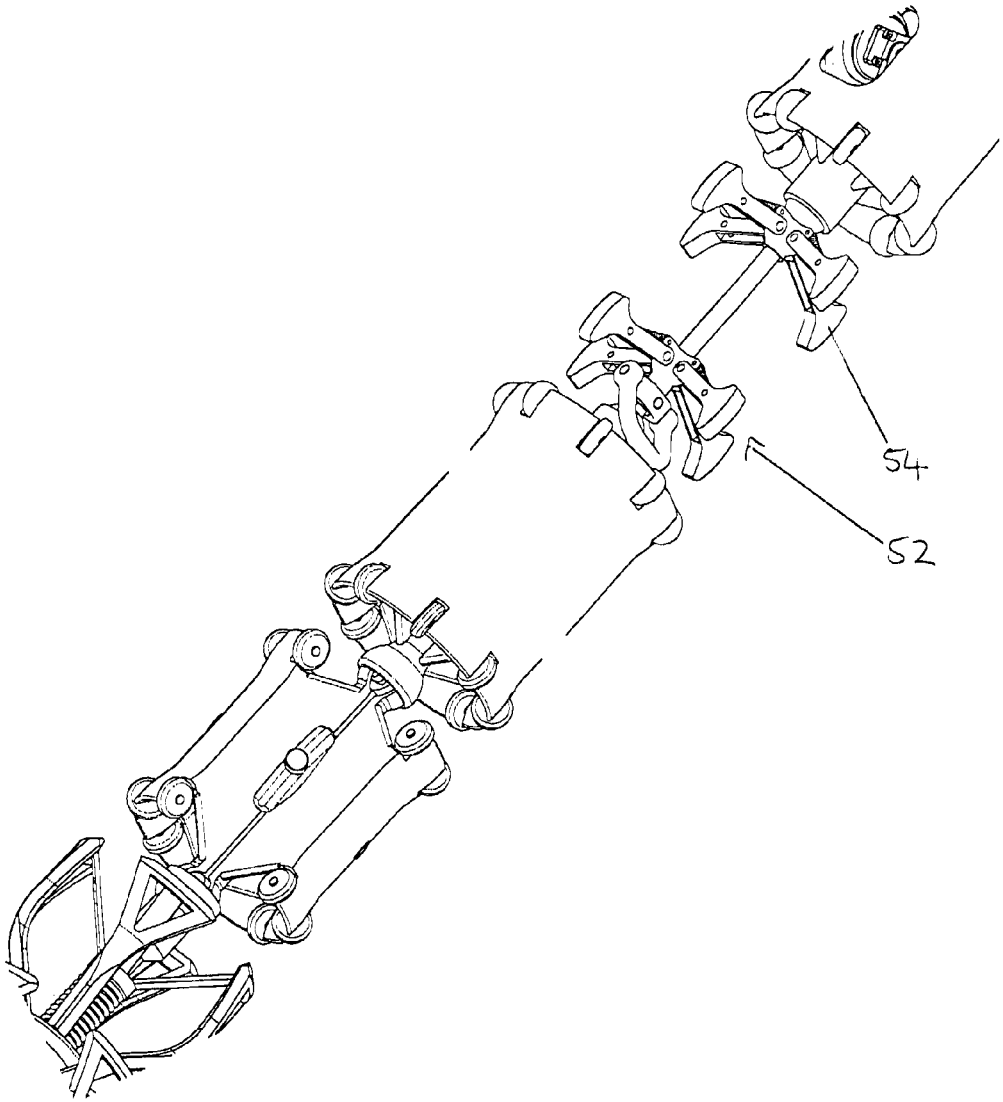
FIG. 11 is a view similar to FIG. 10 whilst crawling against the fluid flow.

Although not shown, a latch mechanism is provided in each of the two central bosses 60, 62 to hold the legs 58 in their retracted positions against the force of the springs 64 (See FIG. 11). The latch is coupled to an actuator (also not shown) in order to allow it to be released remotely when the pig has been carried by fluid flow to the required place to allow it to return. In an alternative envisaged embodiment the legs 58 may be retracted and extended remotely using suitable actuators. This would allow repeated journeys through the pipe without having to remove the pig to re-latch the legs manually.

Figure 7:
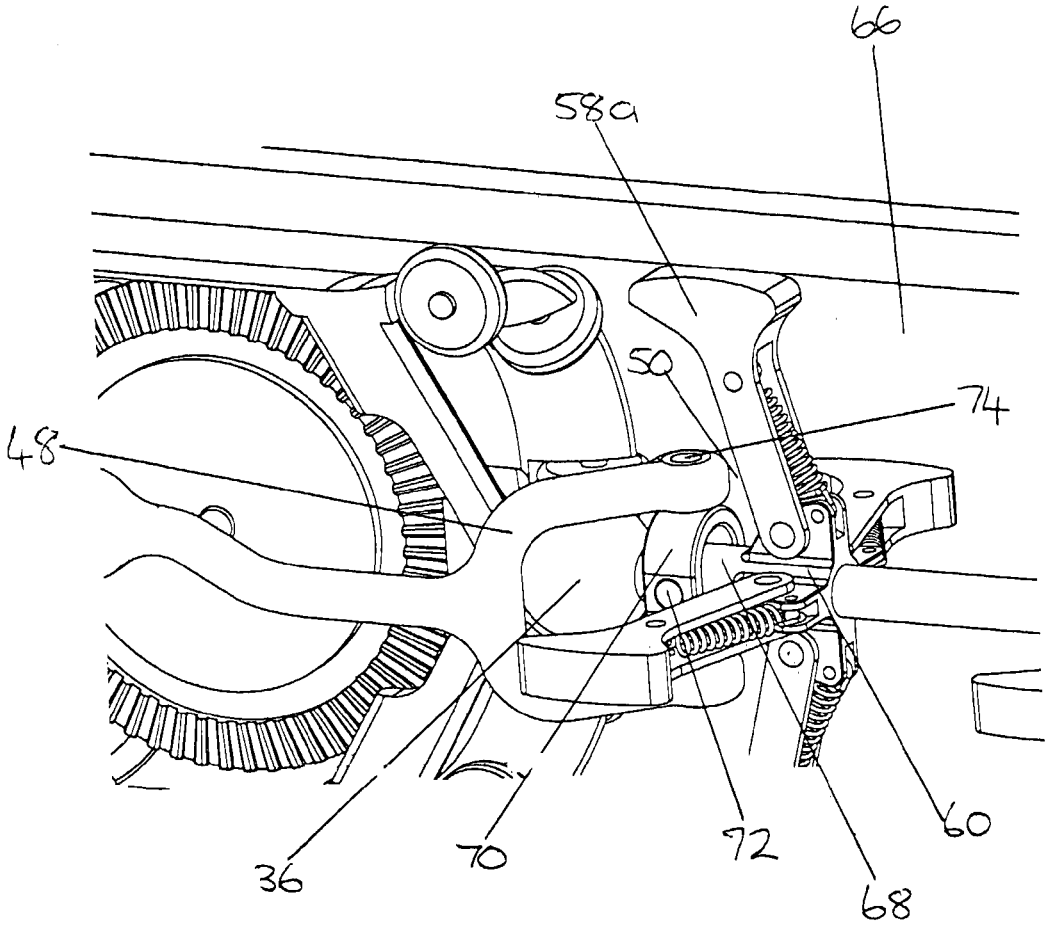
FIG. 7 is an even larger view showing one of the crawling legs.

A more detailed view of the first, sliding set of legs 52 is given in FIG. 7. From this Figure, it will be seen that when the legs are employed the rounded feet 58*a* of the respective legs engage against the inside wall 66 of a pipeline. The actual shape of the feet 58*a* is a logarithmic spiral centered on the pivotal axis of the corresponding leg. This maintains the appropriate angle of contact between the feet 58*a* and the pipe wall 66 constant (when measured parallel to the pipe axis), regardless of where along the sole of the foot 58*a* contact is made. The actual value of the contact angle required is dependent on a number of factors including the material of the inner pipe wall and the fluid flowing in the pipe. For example in a dry concrete pipe an angle of 70 degrees may be sufficient to prevent slipping. However in a stainless steel pipe an angle of up to 86 degrees might be necessary to prevent slipping.

It should be noted that a small gap is shown in the upper part of FIG. 7 for the sake of clarity, but in practice there is direct physical contact between the soles of the feet 58*a* and the pipeline wall 66. The feet 58*a* may be provided with a suitable friction coating such as synthetic rubber in order to aid grip.

Also visible in FIG. 7 is the relationship between the yoke 48 of the crank member coming from the gear module 8, and the sliding coupling 50. In particular, it will be seen that the sliding coupling 50 comprises a sleeve 68 formed integrally with the boss 60 of the sliding set of legs 52 and an oval-section rocking member 70. The rocking member 70 is pivotally attached to the sleeve 68 by means of a pair of pips 72 formed on the sleeve 68 which are received in corresponding holes in the rocking member 70. The two arms of the yoke 48 are attached to the curved ends of the rocking member 70 by respective pivot pins 74. The relative movement between these components afforded by this arrangement may be seen more clearly in FIGS. 8*a* to 8*e*.

FIGS. 8*a* to 8*e* show a partially cut-away view of the gear module 8 and the crawling module 10 of the pig. 8*a* shows the two modules in an initial configuration with the crank 46 at the foremost extent of its travel. The flow of fluid in the pipe is from right to left but the pig is prevented from being carried with the flow by the two sets of legs 52, 54 in frictional engagement with the inside wall of the pipeline 66.

Figure 8A:
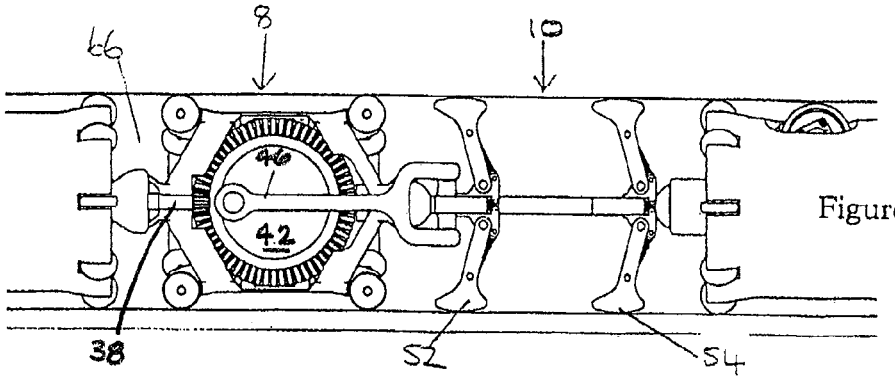
FIGS. 8*a* to 8*e* are side elevations of the gear and crawling modules showing how the pig crawls along a pipeline against the fluid flow.
Figure 8B:
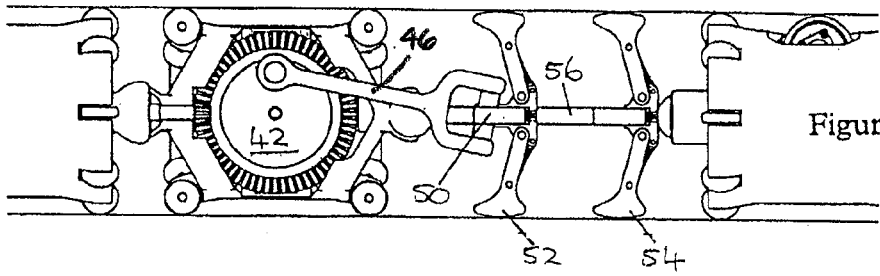

Moving on to FIG. 8*b*, the flow in the pipeline 66 causes the turbine element in the turbine module 6 to rotate which in turn drives the axle 38 at the foremost end of the gear module 8 to drive the crank gear 42 in a clockwise direction. This is translated into a linear drive movement by the crank 46 to push the sliding coupling 50 and thus the sliding set of legs 52 along the shaft 56 towards the stationary set of legs 54. The observed inclination of the crank member is accommodated by the rocking member 70.

Figure 8C:
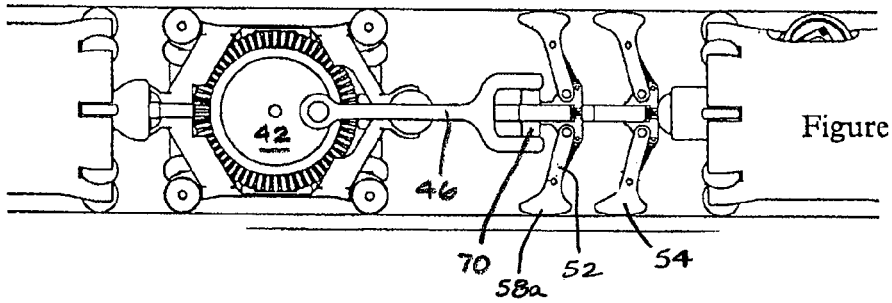
Figure 8D:
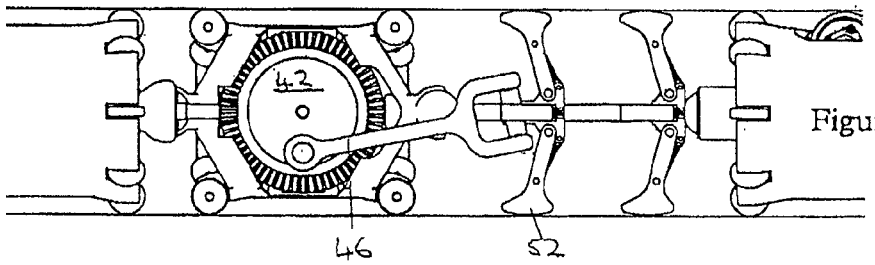

This process is completed in FIG. 8*c* when the crank 46 is at its rearmost position with the two sets of legs 52, 54 approximately adjacent to one another. It will be seen that throughout this part of the movement, the pig overall remains in its original position. However, as the clockwise rotary movement of the crank gear 42 continues, the crank 46 exerts a forward force on the sliding set of legs 52. However, friction between the feet 58*a* on the sliding set of legs 52 and the inside wall of the pipe 66 prevents them from being dragged forward again and thus the reactionary force drags the gear module 8, and therefore all of the modules of the pig, backward. This may be seen in FIG. 8*d*.

Figure 8E:
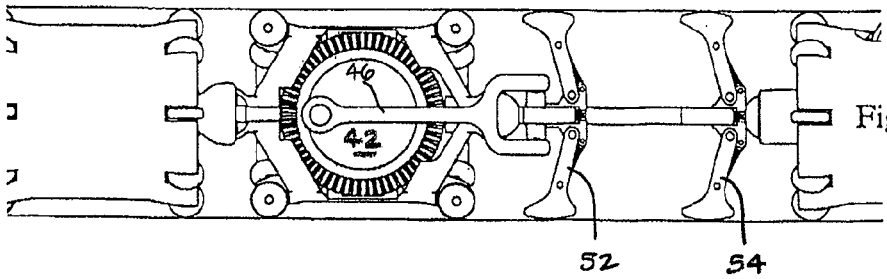

The process continues until the crank 46 again reaches the foremost extent of its travel and the two sets of legs 52, 54 are once again at their maximum separation as shown in FIG. 8*e*. By comparing FIGS. 8*a* and 8*e*, it will be seen that the configuration of the modules is the same in each but that in FIG. 8*e* the whole pig has been moved backwards against the flow in the pipeline. Thus as the flow continues to turn the turbine and therefore the crank gear 42, the whole pig is gradually moved against the flow in a series of steps.

Figure 9:
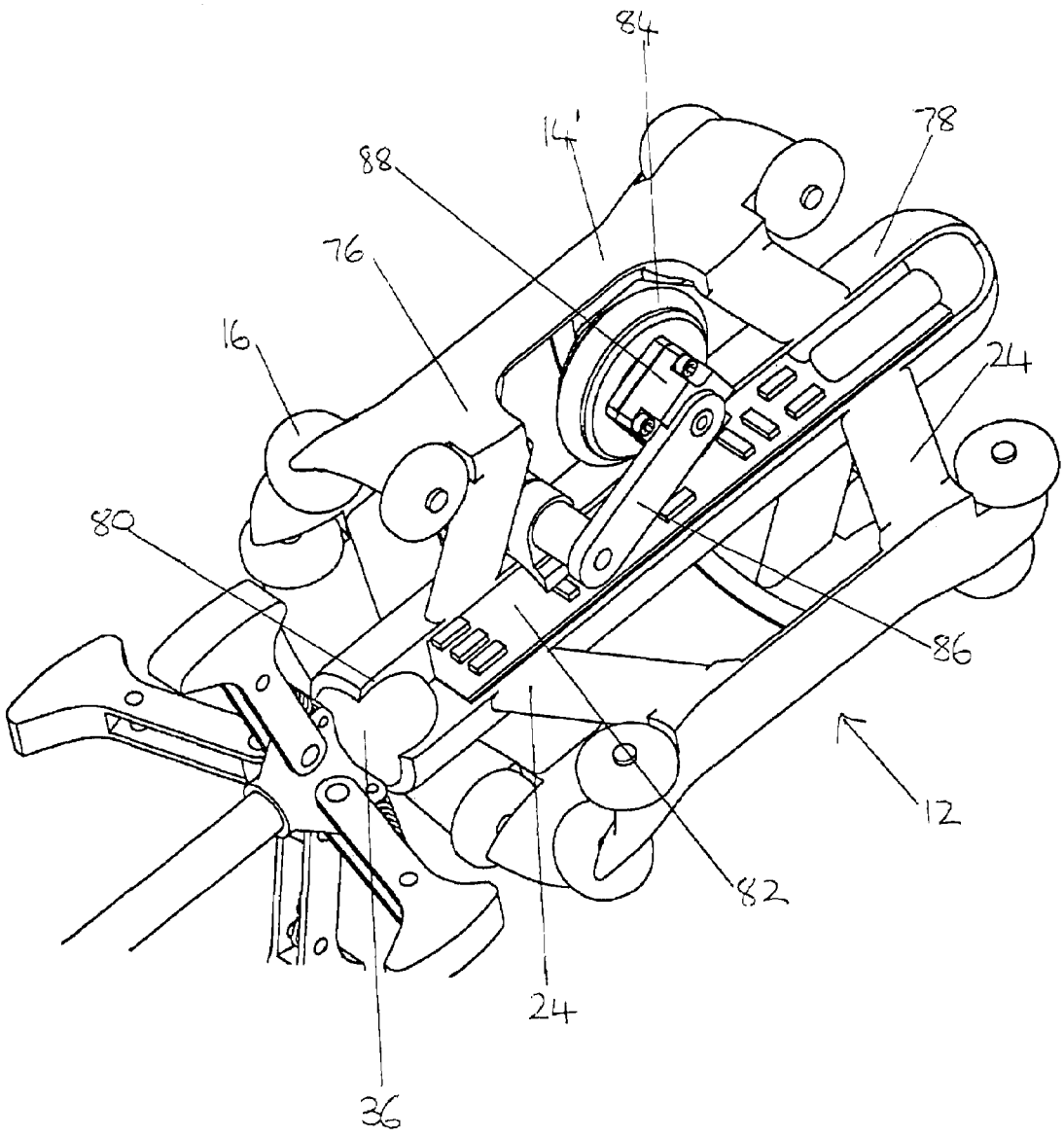
FIG. 9 is a close up view of the control module.

FIG. 9 shows the control module 12 which is located behind the crawling module 10. In common with several of the other modules, the control module comprises a generally cylindrical body 14' with wheels 16 around its two ends. The body 14' differs a little from those of other modules in that it defines an aperture 76 part-way along its length. In common with other modules, two axially-spaced sets of angled spokes 24 are provided. In this module 12, the spokes 24 support a cigar-shaped central body 78. At its fore end, the central body 78 defines a socket 80 for receiving the spherical protrusion 36 at the rear end of the crawling module 10 in order to form a ball and socket joint. The other end of the central body 78 is simply closed since the control module 12 is the last module of the pig.

Inside the central body 78 is an electronic data pack and control unit 82 incorporating microprocessors for controlling the operation of the pig. Flexible cables (omitted for clarity) connect the control unit to the other modules. The cables are run along the central axes of those modules 4, 10 that do not have rotating parts and along the outer housing of those modules 6, 8 that do have rotating parts. Of course the cables are sufficiently flexible and/or slack to allow the modules to hinge with respect to one another. For example the cables may be helically coiled in order to allow them to be stretched elastically.

A sprung follower wheel 84 projects through the apertures 76 in the body of the module in a plane including the axis of the module. A resiliently biased arm 86 holds the wheel 84 against the inside of the pipeline (not shown in this Figure). An odometer 88 measures the rotation of the wheel 84 and converts this into an electrical signal which is transmitted to the data pack 82. This allows the distance that the pig has traveled along the pipeline to be recorded. This information allows the pig to calculate its position along the pipeline. This could be transmitted to an operator or be used to decide when to reverse movement if a predetermined travel distance is programmed.

Operation of the resistance module 4 will now be described with reference to FIGS. 10 and 11. The overall shape of the resistance module 4 is the same as the other modules in that it comprises an approximately cylindrical hollow body 90 with circumferentially mounted wheels 16 around its two ends. However, rather than having angled spokes as in some of the other modules, a series of circumferentially spaced walls extend radially between the inner wall of the body 90 to the axis of the module 4, where they together define a bore along the length of the module which receives an axle 94 therein. The radial walls divide the inside space of the module 4 into a series of wedge-shaped channels.

Figure 10:
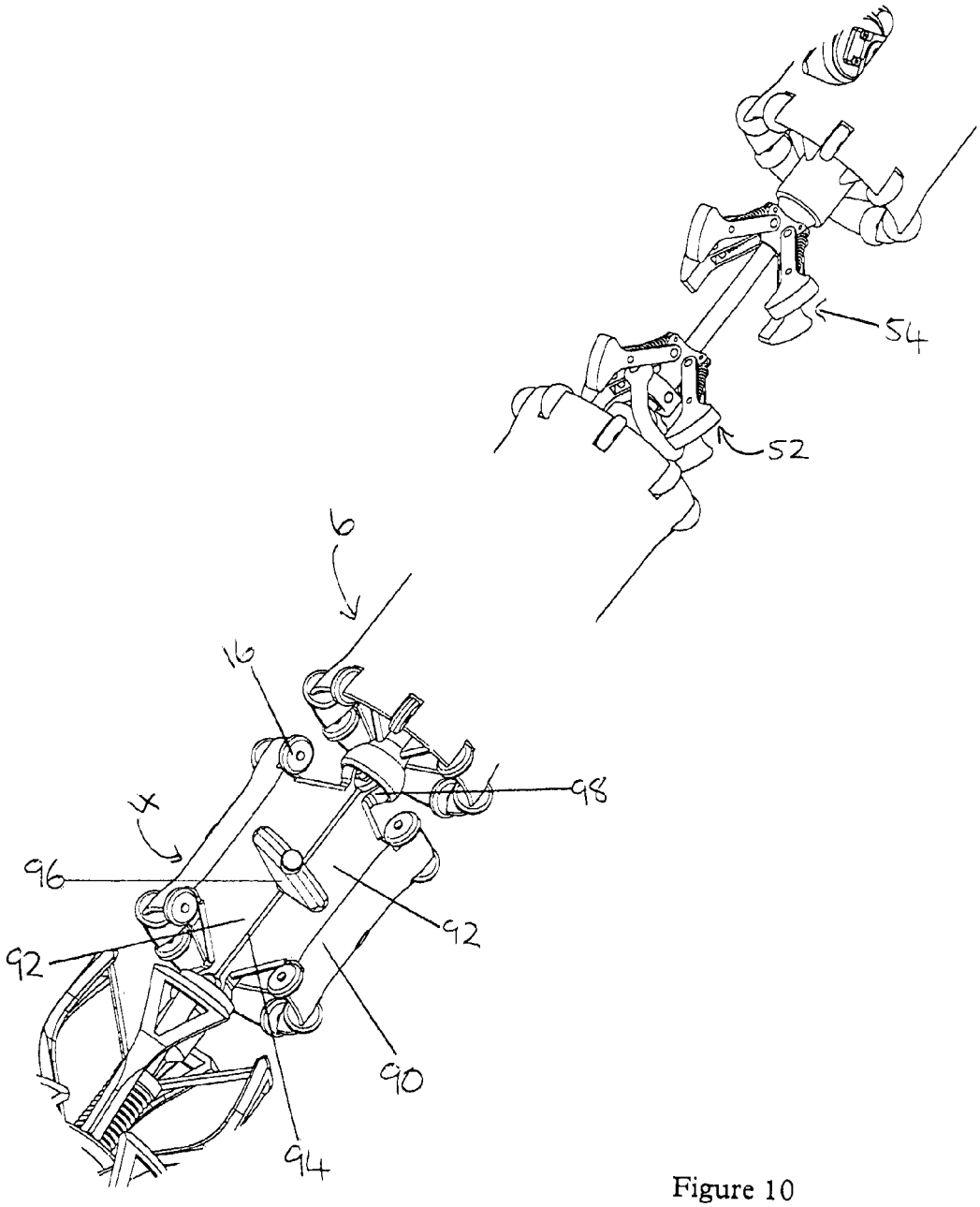
FIG. 10 shows close up views of the resistance module and the crawling module during movement with the fluid flow.

Half-way along each of these channels is provided a correspondingly fan-shaped shutter 96, one of which may be seen in FIG. 10 by virtue of the cutaway section of wall. Each shutter 96 is pivotable about an axis extending radially from the main axis of the module. Therefore, when the shutters 96 are in the position shown in FIG. 10, flow of fluid through the axial channels in the module 4 is substantially impeded. By contrast, when the shutters 96 are rotated through 90 as is shown in FIG. 11, flow of fluid through the module 4 is substantially unimpeded. Thus, the positions of the shutters 96 may be used to control the resistance of the module 4 to the fluid in the pipeline flowing through it. As will be apparent, the configuration shown in FIG. 10 is used when the pig is to be carried forward through the pipeline with the fluid flow whereas the configuration in FIG. 11 is used when the pig is being driven against the direction of the fluid flow.

In an alternative embodiment (not shown) a single butterfly valve could be provided across a passage through the module.

The rear parts of FIGS. 10 and 11 show the positions of the crawling legs 52, 54 corresponding to the respective positions of the shutters 96. Thus in FIG. 10 where the pig is being carried with the fluid flow in the pipeline, the two sets of legs 52, 54 are latched in their retracted positions to allow free movement of the pig along the pipeline. In FIG. 11, when the pig is being driven against the fluid flow, the latches holding the two sets of legs 52, 54 are released, deploying the legs under the force of the springs 64 against the inside of the pipeline wall to allow them to crawl against the wall of the pipeline as was described with reference to FIGS. 8*a* to 8*e*.

Integrally formed with the central portion of the rear edges of the walls 92 of the resistance module 4 is a hollow, partly-spherical protrusion 98 which is received in the socket 34 at the front end of the turbine module 6. A similar protrusion is formed at the front end of the resistance module 4 although this cannot clearly be seen in FIG. 10 or 11. The axle 94 has universal couplings at either end (not shown) which are coupled at the rear end with the universal coupling 32 of the turbine element 18; and at the fore end with the drive shaft of the tool module 2, described below.

Figure 12:
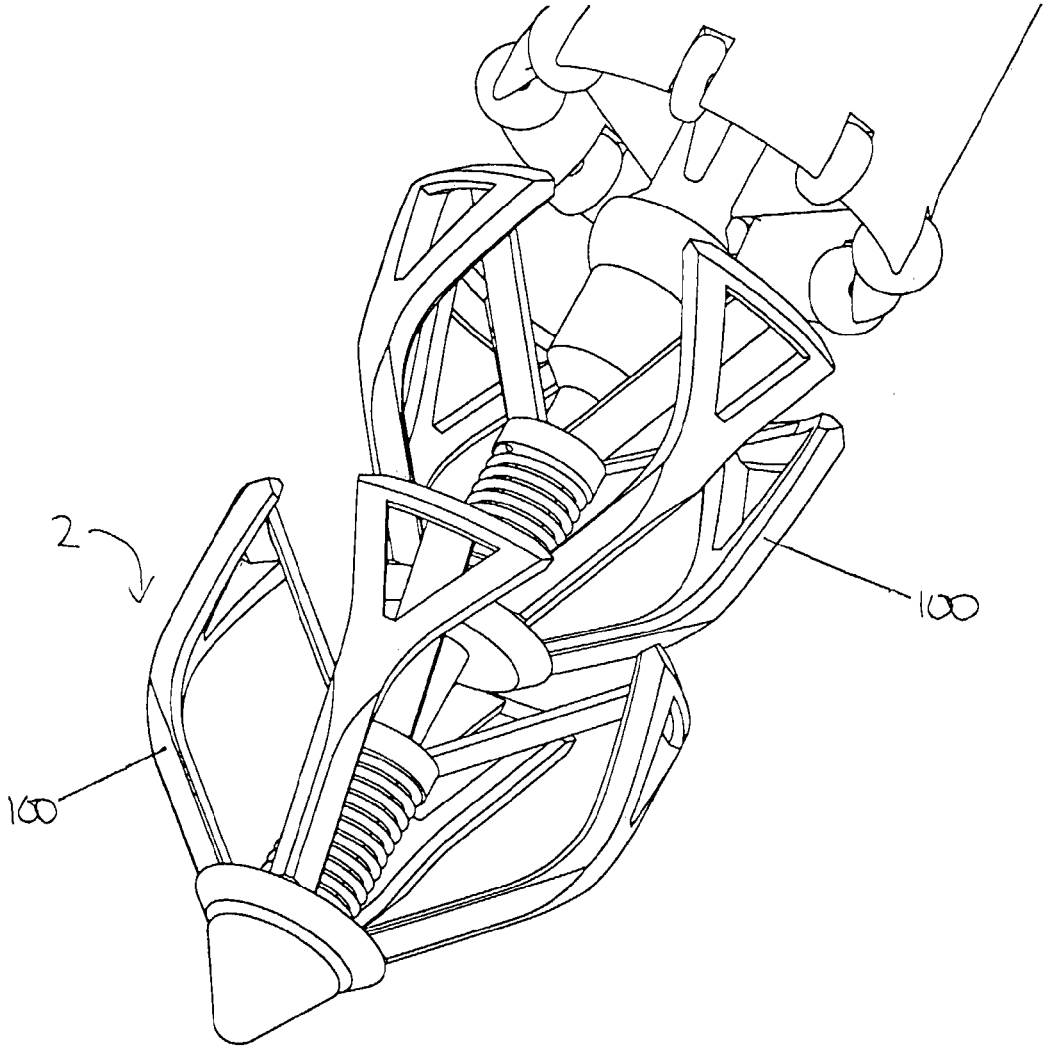
FIG. 12 is a close up view of the tool module at the front of the pig.
Figure 13:
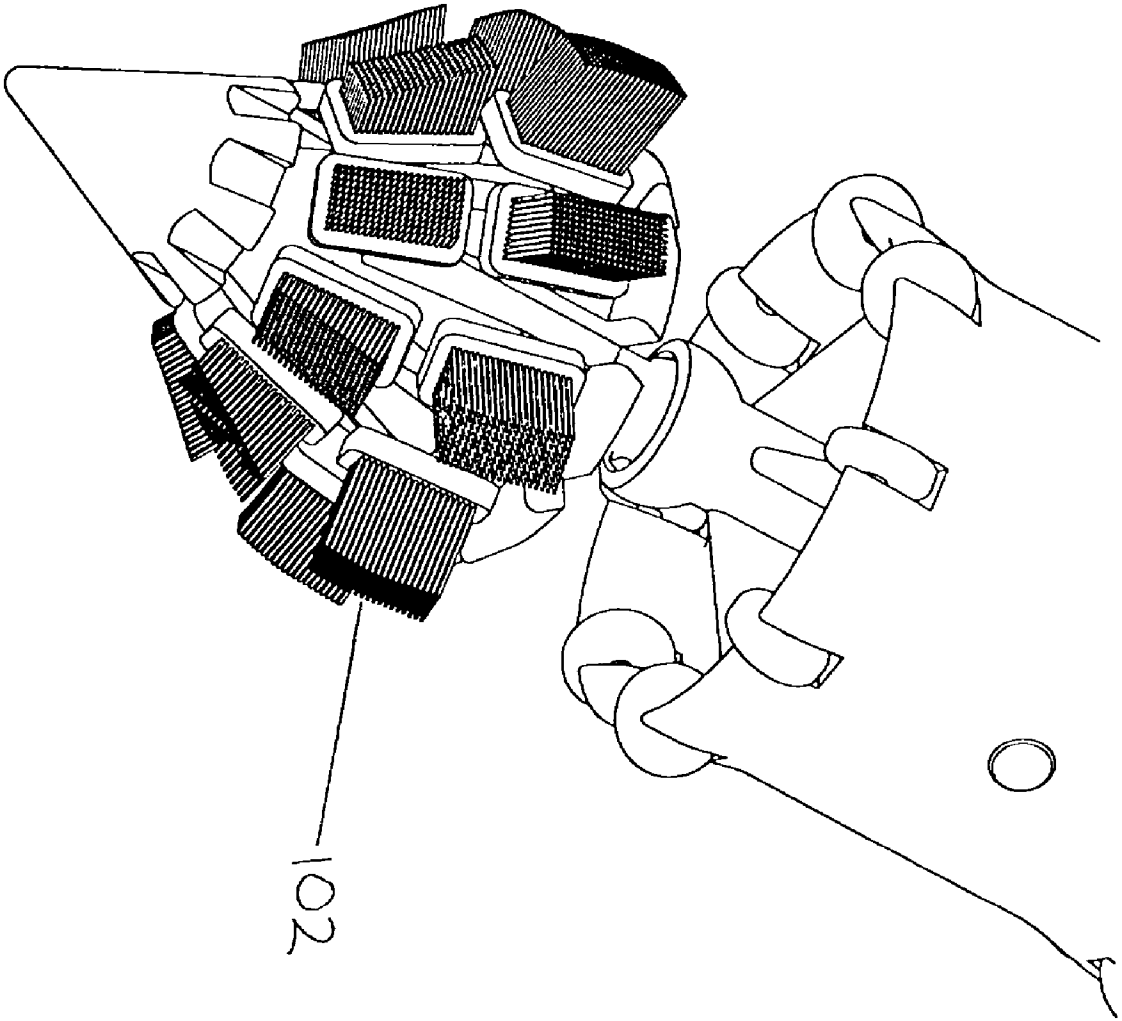
FIG. 13 is a view of an alternative tool module.

The remaining module is the tool module 2 which will be described with reference to FIG. 12. The tool module 2 generally comprises two sets of blades 100 which are supported on a central shaft (not shown). Rotary mechanical drive from the axle 94 extending through the restriction module 4 described above is converted into a reciprocating translational motion by a knob or collar shaft mechanism. Such an arrangement is very effective in removing harder deposits from the inside wall of pipelines. Suitable tools are available from Reinhart SA in Switzerland. FIG. 13 shows an alternative embodiment of the tool module 2 in which a plurality of radially directed brushes 102 is provided which are effective for removing softer deposits.

Overall operation of the pig will now be described with reference to all of the previously described Figures. Firstly, the legs 58 are manually retracted and latched in the retracted position and the restriction module 4 is configured to maximise its resistance to the flow of water through the module by closing the shutters 96. The pig is then as is shown in FIG. 10. The pig is introduced into a pipeline, such as a pipeline for transporting water, at a location upstream of where it is required to operate. As the two sets of crawling legs 52, 54 are retracted and the shutters 96 are closed, this allows the whole pig to be carried along with the water flow to the downstream extent of the predetermined working region of the pipe.

Once the pig has traveled the correct distance along the pipeline in the direction of fluid flow as determined by the control module 12 and in particular the odometer and follower wheel 84, a signal is sent by the control electronics in the control module 12 to the restriction module 4 and the crawling module 10 to open the shutters 96 and to release the crawling legs 52, 54 respectively, as is shown in FIG. 11. This causes the pig to be held at a fixed position against the inside wall of the pipeline 66 whilst allowing the water in the pipeline to flow through the pig.

The water flowing through the pig turns the turbine element 18 thereby causing its shaft 30 to rotate. The rotary mechanical drive is transmitted from the turbine module 6 to the gear module 8 by means of the universal coupling 32 between the respective shafts 30 and 38. The bevelled pinion and crank gears 40, 42 convert this into a perpendicular rotary motion of the latter which is subsequently converted into a reciprocating axial linear drive by the crank member 46. This causes the two sets of legs 52, 54 of the crawling module 10 to pull the whole pig in a series of steps backwards against the water flow as was described above with reference to FIGS. 8*a* to 8*e*.

At the same time, the rotary drive is transmitted forward in the pig from the turbine axle 30 through the front universal coupling 32, via the axle 94 in the restriction module 4 to the tool module 2 to reciprocate vibrate the blades 100. Thus as the whole pig crawls backwards, the blades 100 act to clear the pipeline of any deposits on the inside wall 66. If only soft deposits are anticipated, a brush tool as shown in FIG. 13 could have been used instead.

Figure 14:
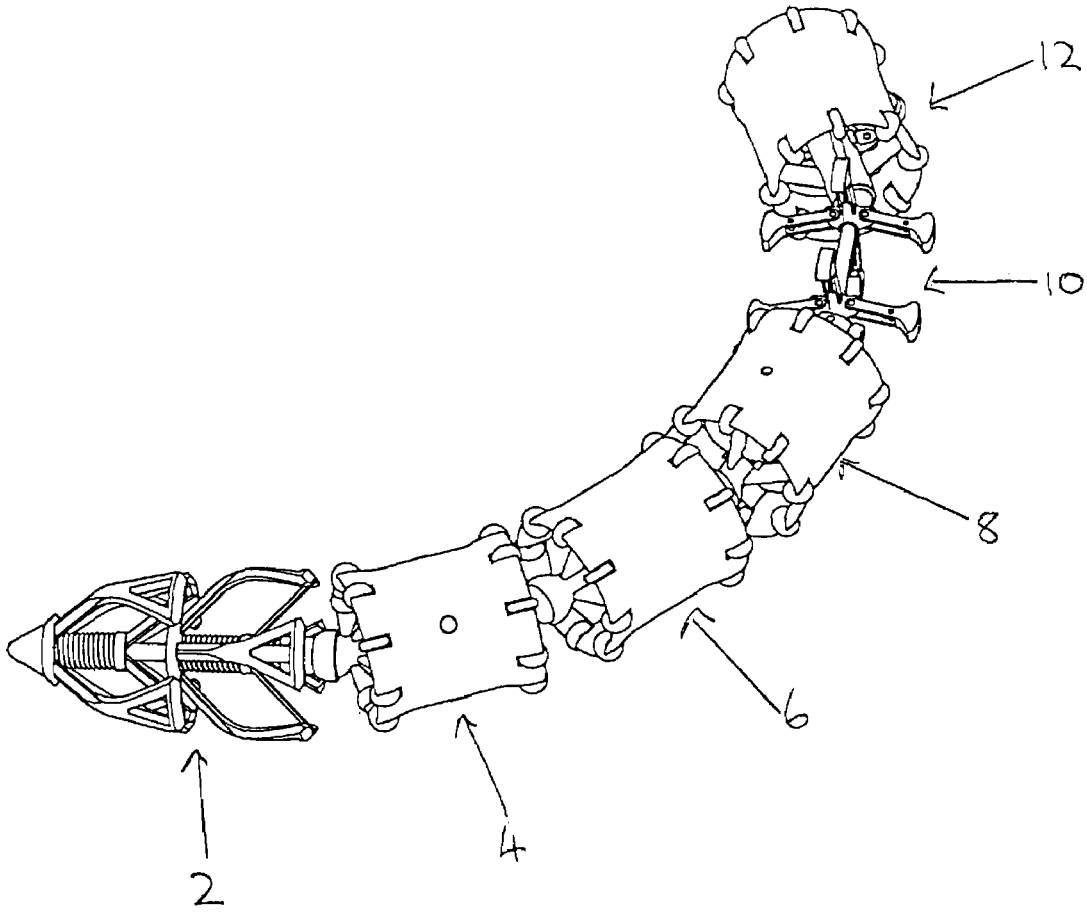
FIG. 14 is a view similar to FIG. 1 showing the pig negotiating bends in a pipeline.

The pig may be used equally in straight or curved pipelines by virtue of the ball and socket joints and, where applicable, universal coupling between each of the modules. A view of the pig negotiating a tight bend is shown in FIG. 14. The described embodiments of the invention are able to negotiate bends having a bend radius of just three times the internal diameter of the pipe. Indeed embodiments employing the principles of the invention are envisaged which are able to negotiate bends up to twice as tight as this—i.e. just one and a half times the internal diameter. An important element of this capacity to negotiate tight bends is the logarithmic spiral shape of the feet 58*a*. This allows the angle between the central axis and the line joining their point of contact with the wall to the pivot axis to be maintained at about 78.5 degrees which prevents slipping even whilst negotiating such bends. Furthermore the previously described crank drive mechanism is still able to drive the legs around tight bends.

Thus it will be appreciated by those skilled in the art that the embodiments described above allow a pig to be introduced into a pipeline to be carried along by the flow therein and subsequently to return, cleaning the inside of the pipeline completely independently without any need for an umbilical cord or on-board power source.

It will furthermore be appreciated however that the described embodiment is simply a single example of the application of the principles of the present invention. Thus many different arrangements of modules and corresponding functionality may be achieved. For example, the transmitting between modules of mechanical drive is advantageous per se. Using power derived from the fluid flow to drive cleaning tools and the like is also advantageous per se. Similarly, the modular construction of the device is advantageous per se.

In accordance with a further embodiment which is not shown in the drawings, the pig has front and rear halves which are moveable relative to one another in an axial direction. In other words the pig can expand and contract in length. The front half has four modules, two of which are leg modules comprising eight legs between them locked axially to their respective modules. The rear half also has four modules, two of which are leg modules with a further eight locked legs between them. There are therefore a total of sixteen legs moveable in two groups of eight. The relatively large number of legs incorporates a degree of redundancy in that not all of the legs need be in contact with the pipe wall to prevent slipping. This allows the device to traverse T-junctions or other portions of the pipe where the wall is not continuous. Additionally or alternatively different legs may be adapted to pipes of different diameters so that a single pig can be used in pipes of varying diameter.

What is claimed is:

1. A device for travelling along a pipeline having fluid flowing in a direction along the pipeline, said device comprising:

a turbine driven by the fluid flowing within the pipeline; and means for moving the device in a direction opposite the fluid flow direction, which means is driven by the turbine, and which means is arranged to move the device in a stepwise manner along the pipeline;

wherein the means for moving the device includes a first set of legs attached to a reciprocating drive mechanism, and a set of second legs, wherein the reciprocating drive mechanism is operable to reciprocally move the set of first legs relative to the set of second legs, and both, the set of first legs and the set of second legs are selectively engageable with an inner surface of the pipeline.

2. A device as claimed in claim 1 adapted to extract all of the power needed to move in the direction opposite the fluid flow direction from said flow.

3. A device as claimed in claim 1 operable without an umbilical cord.

4. A device as claimed in claim 1 comprising means for wirelessly transmitting data.

5. A device as claimed in claim 1 wherein the turbine is mechanically coupled to the means for moving the device such that the moving means is driven mechanically by the fluid flow.

6. A device as claimed in claim 1 wherein said legs comprise a foot portion adapted to contact the inner surface of the pipeline, wherein the foot portion is shaped to include part of a logarithmic spiral centered on the pivotal axis of the leg.

7. A device as claimed in claim 6 comprising one or more tools.

8. A device as claimed in claim 7 wherein at least one of the one or more tools comprises means for removing deposits on the inside of the pipeline wall.

9. A device as claimed in claim 7 comprising means for actively operating the one or more tools.

10. A device as claimed in claim 9 wherein at least one of the one or more tools is driven by power extracted from the fluid flow.

11. A device as claimed in claim 10 wherein the turbine is operable to drive the one or more tools and the means for moving the device.

12. A device as claimed in claim 6 comprising means for receiving remotely transmitted control signals.

13. A device as claimed in claim 6 comprising a generator for generating electrical power from the fluid flow for powering electronic equipment onboard the device.

14. A device as claimed in claim 6 comprising a plurality of modules.

15. A device as claimed in claim 14 wherein at least some of the modules are coupled to one another in such a way as to transmit mechanical drive between them.

16. A device as claimed in claim 1 wherein said legs have a contact angle with the inner surface of the pipeline of between 70 and 86 degrees.

17. A device as claimed in claim 1 wherein the legs are operated by a crank mechanism driven by the fluid flow.

18. A device as claimed in claim 17 wherein said crank mechanism comprises a crank wheel whose axis is perpendicular to a main axis of the device.

19. A device as claimed in claim 17 wherein the eccentricity of the crank mechanism is adjustable.

20. A device as claimed in claim 1 comprising means for deploying the legs when required.

21. A device as claimed in claim 20 wherein the legs are resiliently biased to their deployed position, the deployment means comprising releasable latch means for holding the legs in their retracted positions such that the legs may be deployed by releasing the latch.

22. A device as claimed in claim 20 comprising one or more actuators for deploying or retracting the legs.

23. A device as claimed in claim 20, wherein each set of legs is coupled together such that they may be deployed as one.

* * * * *